US007357669B2

(12) United States Patent
Gabet

(10) Patent No.: US 7,357,669 B2
(45) Date of Patent: Apr. 15, 2008

(54) ELECTRICAL CONNECTION ASSEMBLY

(75) Inventor: Denis Gabet, La Buisse (FR)

(73) Assignee: RADIALL, Rosny-Sous-Bois (FR)

( * ) Notice: Subject to any disclaimer, the term of this patent is extended or adjusted under 35 U.S.C. 154(b) by 0 days.

(21) Appl. No.: 11/484,693

(22) Filed: Jul. 12, 2006

(65) Prior Publication Data

US 2007/0015403 A1 Jan. 18, 2007

(30) Foreign Application Priority Data

Jul. 12, 2005 (FR) ..... 05 07459

(51) Int. Cl.
*H01R 13/73* (2006.01)

(52) U.S. Cl. ..... 439/549

(58) Field of Classification Search ..... 439/546–549
See application file for complete search history.

(56) References Cited

U.S. PATENT DOCUMENTS 3,894,205 A * 7/1975 List et al. ..... 200/51.07
4,029,953 A * 6/1977 Natoli ..... 362/382
4,148,542 A 4/1979 Wood
4,373,771 A 2/1983 Cross et al.
4,427,255 A 1/1984 Cox
4,653,708 A 3/1987 Rich
5,225,970 A 7/1993 Palumbo
5,624,167 A 4/1997 Katz
5,772,469 A 6/1998 Polgar et al.
5,984,721 A 11/1999 Self, Jr. et al.
6,083,040 A * 7/2000 Mosquera ..... 439/548
6,508,666 B1 1/2003 Francis
6,783,396 B1 8/2004 Osterhart et al.
6,800,808 B1 10/2004 Chung
2002/0066847 A1 6/2002 Belknap

FOREIGN PATENT DOCUMENTS

DE 196 18 818 A1 11/1997
DE 199 07 798 C1 7/2000
EP 0 893 852 A2 1/1999

* cited by examiner

*Primary Examiner*—Ross Gushi
(74) *Attorney, Agent, or Firm*—Oliff & Berridge, PLC

(57) ABSTRACT

An electrical connection assembly may include:
a panel including at least one opening; and
an electrical connector configured to be engaged through the opening of the panel. The connector may include an enlarged portion configured to press against a first face of the panel when the connector is engaged therewith. The panel may include at least first and second abutment elements. The first abutment element may project from a second face of the panel opposite from the first face. The connector may include at least one locking portion configured to go past, in particular by snap-fastening, the first abutment element of the panel as a result of the connector performing a turning movement relative to the panel to enable the connector to be locked to the panel. The connector may be configured to be held stationary relative to the panel by pressing against the first and second abutment elements.

16 Claims, 7 Drawing Sheets

Fig.5
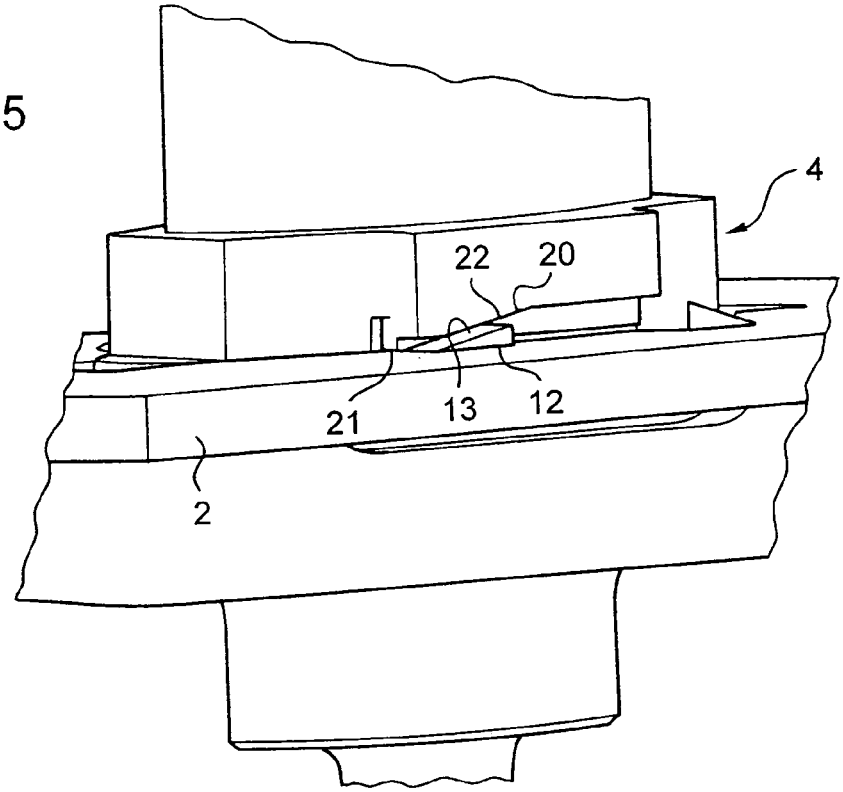
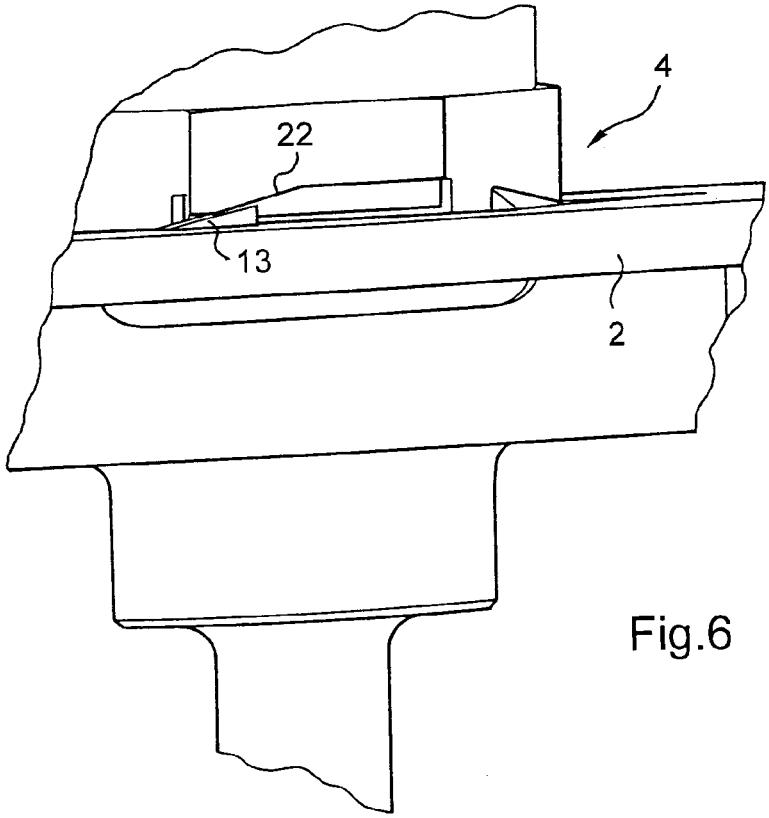
Fig.6

Fig.7
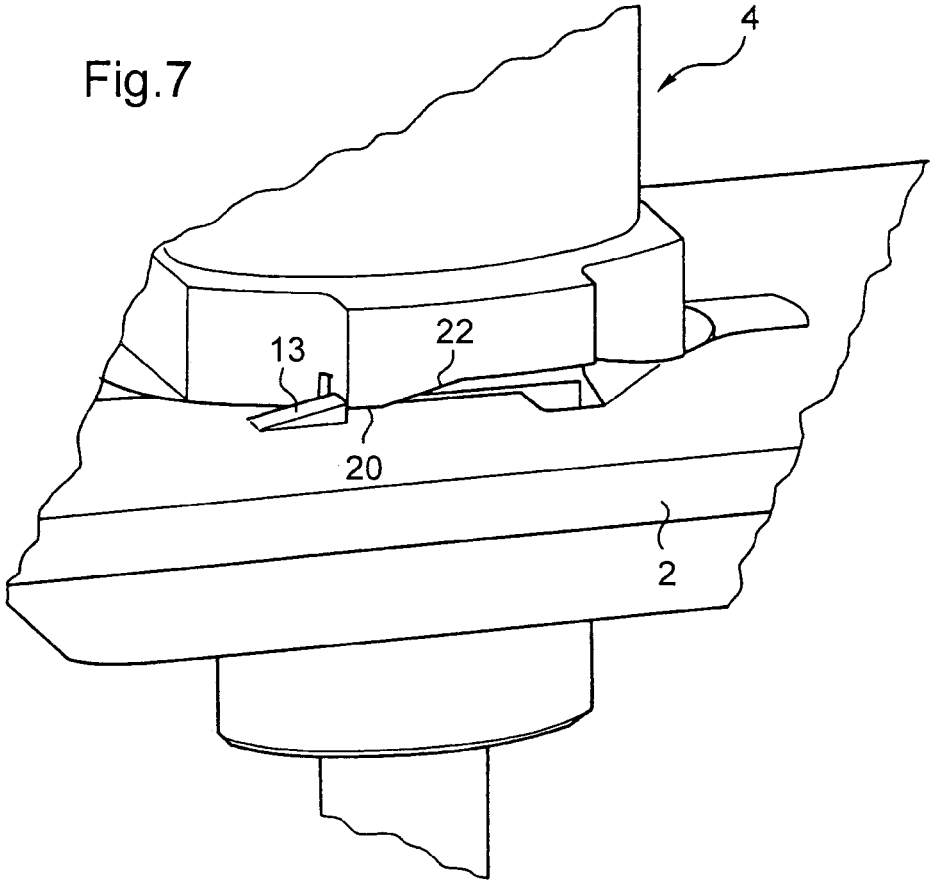
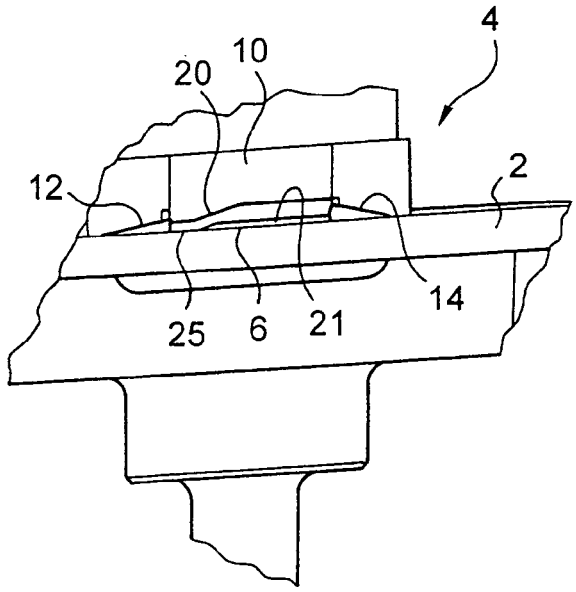
Fig.8

Fig.9
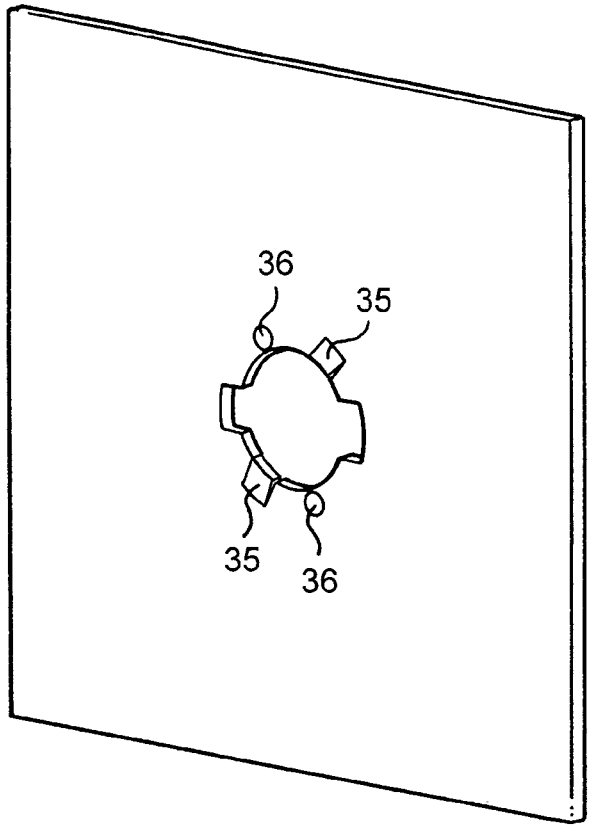
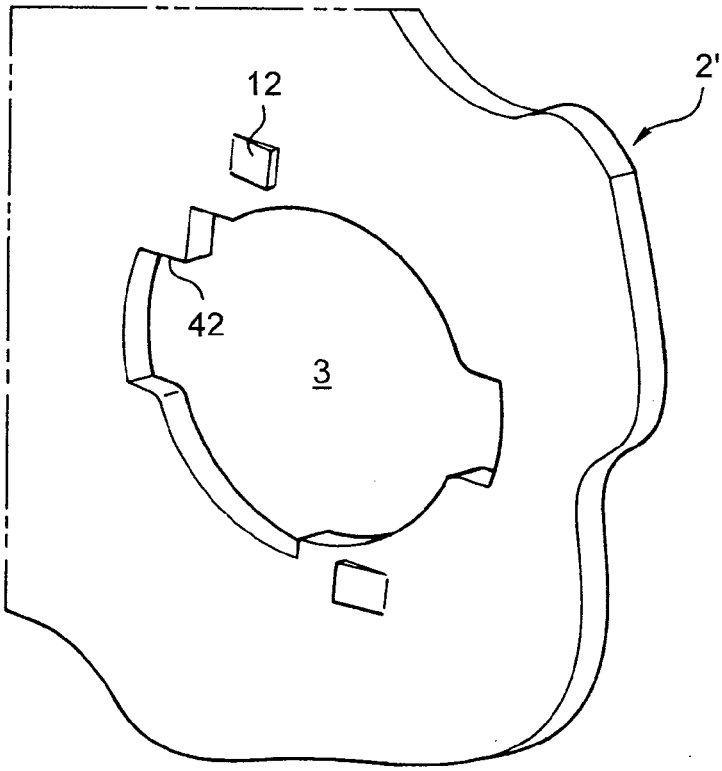
Fig.11

ELECTRICAL CONNECTION ASSEMBLY

The present invention relates in particular to an electrical connection assembly comprising a panel and an electrical connector suitable for being engaged through an opening in the panel.

BACKGROUND

U.S. Pat. No. 6,783,396 discloses a connector enabling cables to be connected through a panel separating a leaktight chamber from the ambient atmosphere.

U.S. Pat. No. 5,772,469 describes an electrical connector suitable for being assembled to a panel. The connector-comprises a dielectric housing with flanges enabling the housing to be held in an opening in the panel. The housing also has a locking arm provided with a protrusion that is engaged in an additional orifice in the panel so as to allow the housing to float relative to the panel in rotation and in translation.

U.S. Pat. No. 4,653,708 describes a thermostat suitable for engaging through an opening in the panel.

U.S. Pat. No. 4,148,542 describes a connector suitable for being secured to a panel through an opening therein, the connector having deformable collars that press against a face of the panel.

U.S. Pat. No. 4,373,771 describes a lamp socket suitable for engaging in an opening of a panel.

U.S. Pat. No. 5,225,970 describes engaging an electromechanical component on a panel through an opening therein. The component has locking tabs serving to prevent the component from moving relative to the panel.

U.S. Pat. No. 5,984,721 describes a connector suitable for engaging in an opening in a panel, the connector including a helical ramp enabling it to be locked to the panel by being turned.

SUMMARY

The invention seeks in particular to make it easy to engage an electrical connector in an opening in a panel.

The invention thus provides an electrical connection assembly comprising:

a panel including at least one opening; and an electrical connector arranged to be engaged through the opening of the panel, the connector having an enlarged portion arranged to press against a first face of the panel when the connector is engaged therewith;

wherein:

the panel includes at least first and second abutment elements, the first abutment element at least projecting from a second face of the panel opposite from the first face; and the connector includes at least one locking portion arranged to go past, in particular by snap-fastening, the first abutment element of the panel as a result of the connector performing a turning movement relative to the panel in order to enable the connector to be locked to the panel, the connector being arranged to be prevented from moving relative to the panel by pressing against the first and second abutment elements.

The second abutment element may project from the second face of the panel, and the locking portion of the connector may be arranged to engage between the first and second abutment elements when the connector is locked to the panel.

In a variant, the second abutment element may be made in the thickness of the panel, in its opening, without projecting from the second face of the panel, and the connector may include at least one tab, in particular a tab that is distinct from the locking portion(s) and that is arranged to press against the second abutment element when the connector is locked to the panel.

By means of the invention, the electrical connector can be secured to the panel, in particular without using any crimping, shrinking, or screw-fastening.

The invention can also make it possible to avoid having recourse to any separate part distinct from the electrical connector for locking the connector to the panel. For example there is no need to use a nut for locking the connector to the panel.

The connector can be thus engaged with the panel relatively quickly and effectively.

Preferably, the panel includes at least one electrically conductive zone and the connector includes at least one electrically conductive portion that comes into contact with the electrically conductive zone of the panel when the connector is locked to the panel, so as to provide a ground connection between the panel and the connector.

In an embodiment of the invention, the panel is made of an electrically conductive material, e.g. galvanized steel.

The enlarged portion of the connector is preferably electrically conductive.

The enlarged portion of the connector may comprise a plate presenting a face that comes into contact with the first face of the panel when the connector is locked to the panel.

In an embodiment of the invention, the locking portion of the connector includes a locking surface arranged to press against the first abutment element when the connector is turned relative to the panel for locking purposes.

The locking surface of the connector may be arranged, if so desired, to be spaced apart from the second face of the panel, at least when the connector is locked to the panel. In a variant, the locking surface comes into contact with the second face of the panel at the end of the locking operation.

In an embodiment of the invention, the first abutment element comprises a first ramp and the locking surface comprises a second ramp suitable for pressing against the first ramp of the abutment element while the connector is being turned relative to the panel for locking purposes. In particular the first and second ramps may be plane. In a variant they may be curved.

During the operation of engaging the connector with the panel, co-operation between the first and second ramps increases the force required to turn the connector relative to the panel.

The locking surface may be arranged in such a manner that at the end of the operation of locking the connector to the panel, said locking surface ceases to co-operate with the first ramp of the abutment element.

Thus, the end of the locking operation can be marked by an audible sound at the moment when the locking surface of the connector disengages from the first ramp of the abutment element.

The abutment elements of the panel and the locking portion of the connector may be arranged in such a manner that the locking portion engages in removable manner, or in a variant in non-removable manner, between the abutment elements of the panel. For example, one of the abutment elements may include a ramp arranged so that it can be passed by turning the connector in one direction only, so as to prevent unlocking by turning the connector in the opposite direction.

The abutment elements of the panel may be made in various ways.

For example, at least one of the abutment elements may be formed by stamping the panel, or by cutting out an elastically deformable tab from the panel, or by providing a fitting which may be welded, stuck, or crimped to one of the faces of the panel, for example.

In an embodiment of the invention, at least one of the abutment elements is formed by a boss, e.g. substantially in the form of a spherical cap.

Preferably, the connector includes a clamping surface arranged to press against the second face of the panel, at least when the connector is locked to the panel, and in particular also while the connector is being turned relative to the panel for locking purposes.

When in the locking position, this clamping surface serves in particular to ensure that the enlarged portion of the connector presses against the first face of the panel with a certain amount of pressure, thereby ensuring an effective ground connection between the panel and the connector.

The clamping surface may be formed at least in part on the locking portion of the connector, said clamping surface extending for example substantially parallel to a locking surface of the locking portion.

Pressing the clamping surface against the second face of the panel with a certain amount of pressure serves to eliminate any slack between the connector and the panel, and thus to eliminate any vibration noise.

The simultaneous presence of a locking surface and a clamping surface also makes it possible to ensure that the torque that needs to be applied to the connector while it is being engaged in the panel increases progressively.

For example, at the beginning of the turning of the connector relative to the panel, an opposing torque is provided solely by contact between the clamping surface and the second face of the panel.

After turning through a predetermined angle, e.g. close to 60°, the locking surface comes to press against the first abutment element of the panel, thereby increasing the opposing torque.

In an embodiment of the invention, the connector has at least two angularly spaced apart locking portions and the opening in the panel has two zones arranged to enable the locking portions of the connector to be inserted through the opening, the locking portions of the connector and said zones of the opening in the panel being arranged, where appropriate, so that the connector can be locked to the panel only when the connector is in one particular orientation relative to the panel.

The invention thus makes it possible to define a keying system enabling the connector to be engaged with the panel at a predetermined orientation and/or preventing a connector that does not match the panel being locked thereto.

In an embodiment of the invention, the connector has a longitudinal axis and the locking portions of the connector are arranged in a manner that is asymmetrical about the longitudinal axis of the connector.

For example, the connector may have two locking portions that are spaced apart from each other by an angle other than 180° when the connector is observed along the longitudinal axis.

The locking portions of the connector may be made of different shapes and/or dimensions so as to provide a keying function.

The invention applies in particular to the automobile and telecommunications industries.

The connector may include a portion for receiving one or more electric cables.

The connector may be of the male type or of the female type, and it may be arranged to be suitable for engaging the panel from in front or from behind.

The invention also provides a panel for an assembly as described above and presenting:

at least one opening; and first and second abutment elements, the first abutment element at least projecting from one of the faces of the panel.

The invention also provides an electrical connector for an assembly as defined above, and presenting:

an enlarged portion arranged to press against a first face of the panel with which the connector can be engaged;

at least one locking portion arranged to go past the first abutment element of the panel, in particular by snap-fastening.

Preferably, the locking portion of the connector includes at least one clamping surface arranged to press against a second face of the panel, at least when the connector is locked to the panel.

The locking portion may have a locking surface arranged to press against the first abutment element of the panel while the connector is being turned relative to the panel for locking purposes, said locking surface being distinct from the clamping surface.

The invention also provides a method of engaging a connector with a panel in an assembly as defined above, the method comprising the following steps:

inserting the connector through the opening in the panel so that the enlarged portion of the connector comes to face the first face of the panel and the locking portion comes to face its second face; and turning the connector relative to the panel so as to cause the locking portion to go past the first abutment element.

BRIEF DESCRIPTION OF THE DRAWINGS

The invention can be better understood on reading the following detailed description of non-limiting embodiments of the invention, and on examining the accompanying drawings, in which:

FIGS. 3 to 8 are diagrams showing different steps in engaging the connector to the panel of the FIG. 1 assembly;

FIG. 9 is a fragmentary and diagrammatic view of a panel constituting another embodiment of the invention;

FIG. 11 is a fragmentary and diagrammatic view in perspective of a panel in accordance with the invention.

MORE DETAILED DESCRIPTION

Figure 1:
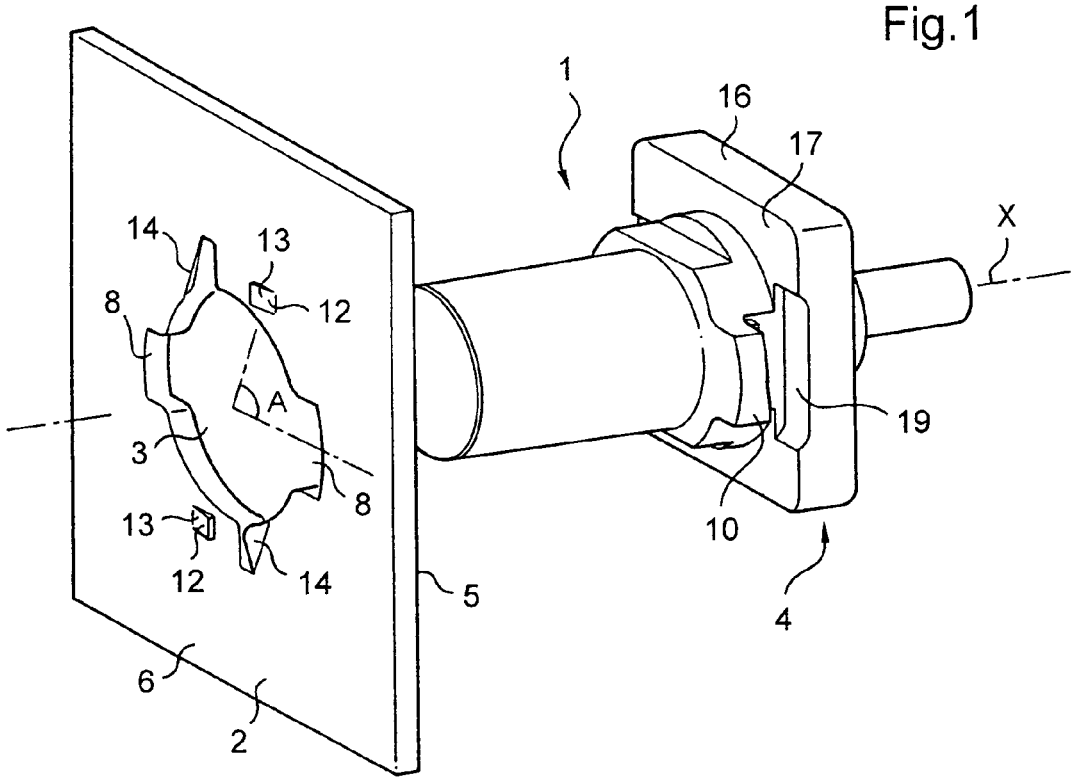
FIG. 1 is a fragmentary and diagrammatic view in perspective of a panel and an electrical connector of an electrical connection assembly in accordance with the invention.

FIG. 1 shows an assembly 1 in accordance with the invention comprising a panel 2 provided with an opening 3 arranged to enable an electrical connector 4 to engage said panel 2.

The panel has a first face 5 and a second face 6 opposite the first, the faces being substantially plane.

The panel 2 is made of an electrically conductive material, e.g. galvanized steel.

In a variant, the panel 2 may be made of a material that is not electrically conductive and that is coated on each of its faces 5 and 6 in a conductive coating.

In another variant, the panel 2 may be made of a material that is not electrically conductive and without a conductive coating, in which case the electromagnetic shielding function is no longer provided.

In the example described, the panel 2 forms part of a multimedia system for a motor vehicle, such as a digital radio, a television, a navigation device, or a mobile telephony device, and the connector 4 serves for example to convey a microwave signal coming from an antenna or some other piece of equipment into the equipment that has the panel 2.

The opening 3 is substantially circular in shape and includes two substantially diametrically opposite zones 8 that are arranged to pass two respective locking portions 10 of the connector 4.

The panel 2 has first abutment elements 12 projecting from the second face 6, each of these abutment elements 12 presenting a respective ramp 13 with a substantially plane top surface that is inclined relative to the face 6 of the panel.

The panel 2 also has second abutment elements 14, each associated with a respective first abutment element 12.

These second abutment elements 14 also project from the second face 6 of the panel 2.

In the example described, the first and second abutment elements 12 and 14 are made by cutting and stamping, or by folding. Each first abutment element 12 is spaced apart from a corresponding zone 8 of the opening 3 by a predetermined angle A.

This angle A may be close to 60° for example, or in a variant close to 30° or 90°, for example.

The connector 4 has an enlarged portion 16 formed by a plate in the example described, this plate 16 presenting a substantially plane face 17 for pressing against the first face 5 of the panel 2 when the connector 4 is locked to the panel 2.

The plate 16 is made of an electrically conductive material, e.g. of Zamak (a zinc alloy) coated in copper and nickel to protect it against corrosion.

The face 17 of the plate 16 extends substantially perpendicularly to a longitudinal axis X of the connector 4.

The plate 16 presents dimensions that are smaller than the opening 3 in the panel 2.

Figure 2:
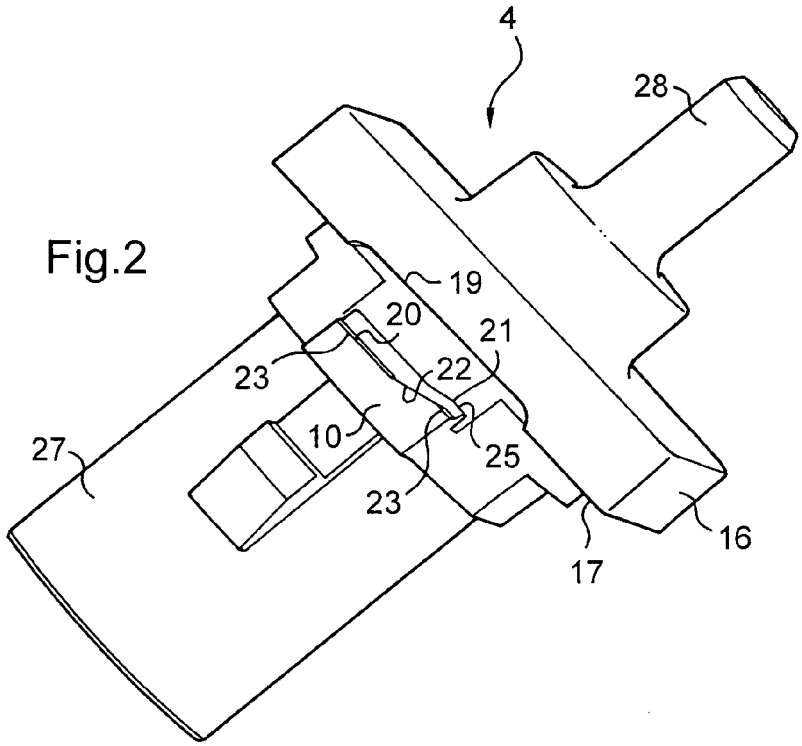
FIG. 2 is a fragmentary and diagrammatic perspective view of the connector of the FIG. 1 assembly.

Each of the two locking portions 10 of the connector 4 has a locking surface 20 and a clamping surface 21, as shown in FIG. 2.

Each locking surface 20 has a second ramp 22 arranged to co-operate with the first ramp 13 of one of the abutment elements 12 of the panel 2.

In the example described, the ramp 22 is substantially plane.

Each locking surface 20 presents substantially plane portions 23 on either side of the ramp 22.

The clamping surface 21 is substantially parallel to the locking surface 22 when the locking portion is observed along an axis perpendicular to the axis X.

The clamping surface 21 has a substantially plane low portion 25 for pressing against the face 6 of the panel when the connector 4 is engaged therewith.

The distance between the low portion 25 of the clamping surface 21 and the face 17 of the plate 16 is selected to be slightly less than the thickness of the panel 2.

Thus, when the connector 4 is engaged with the panel 2, the face 17 of the plate 16 comes to press with a certain amount of pressure against the face 5 of the panel 2 and the low portion 25 comes to press against the face 6 of the panel 2.

The locking portions 10 may optionally be made integrally with the plate 16.

The plate 16 includes two setbacks 19 each in register with a respective locking portion 10.

The connector 4 has a first tubular connection portion 27 extending from a first side of the plate 16, and a second tubular connection portion 18 extending from a second side of the plate 16, opposite from the first side.

In the example described, the connection portion 27 serves for connection with a complementary connector (not shown) for the purpose of transmitting a microwave signal, while the connection portion 28 serves for connection with a coaxial cable (not shown).

The connection portion 21 may be replaced by a portion for making direct connection with a central contact on a circuit.

With reference to FIGS. 3 to 8, there follows a description of the various steps in engaging the connector 4 with the panel 2.

The connection portion 24 is initially inserted together with the locking portions 10 of the connector 4 through the opening 3, the locking portions 10 passing through said opening 3 via its zones 8.

The face 17 of the plate 16 comes into contact with the face 5 of the panel 2.

Figure 3:
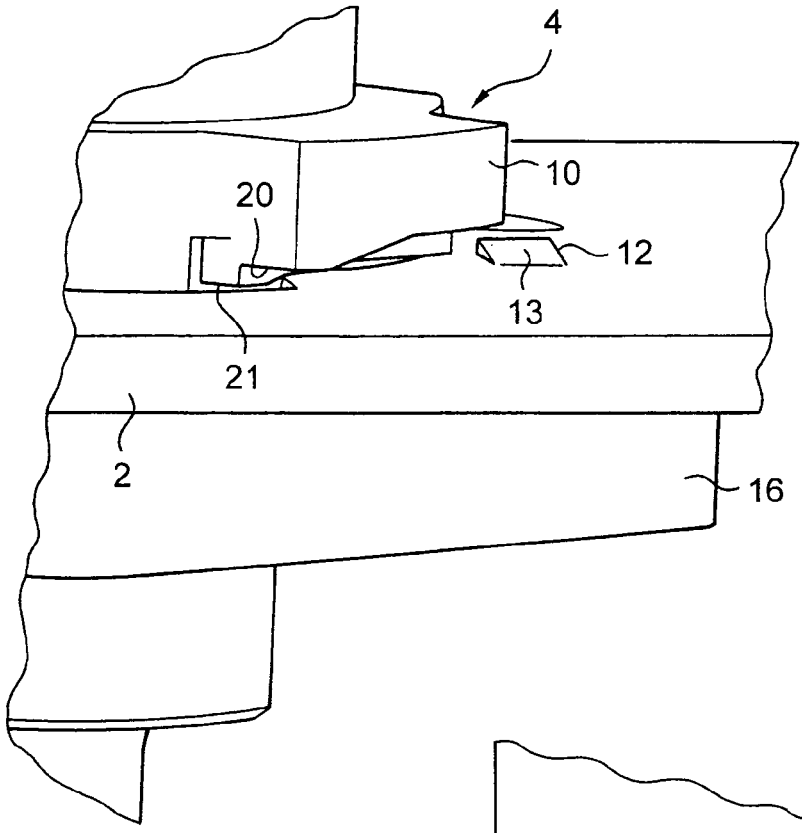

The connector 4 is then turned relative to the panel 2 in a predetermined direction, as shown in FIG. 3.

Figure 4:
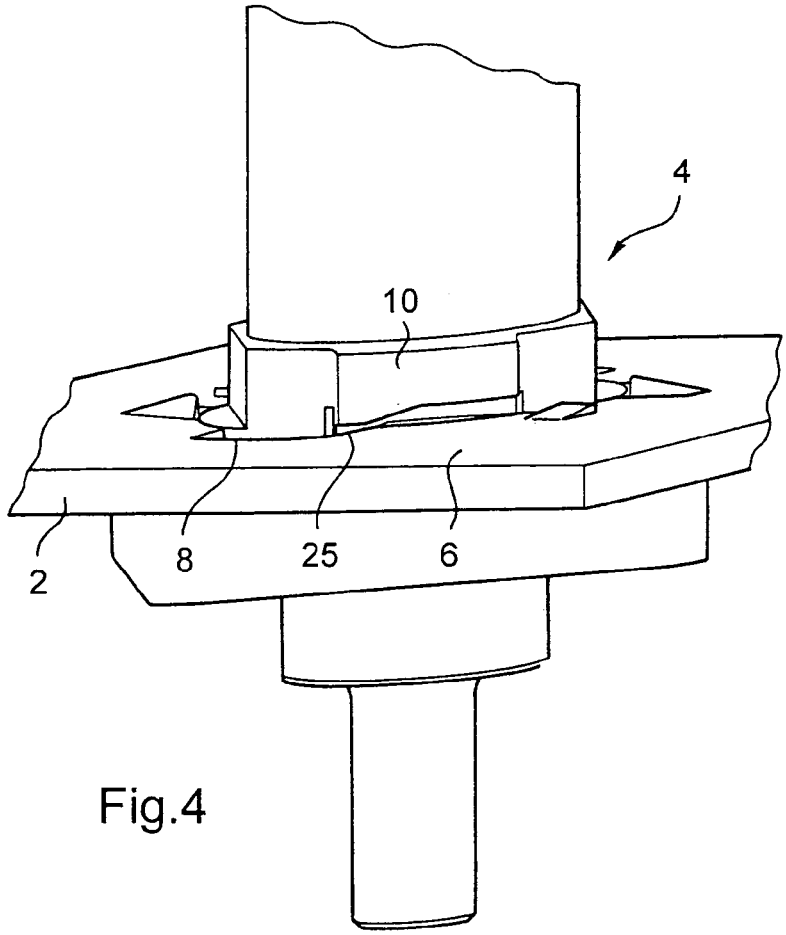

After turning through a certain angle, the low portion 25 of the clamping surface 21 leaves the zone 8 of the opening 3 and comes to press against the face 6 of the panel 2, as shown in FIG. 4.

The contact between said portion 25 and the face 6 of the panel 2 generates opposing torque as the connector 4 continues to be turned relative to the panel 2.

After the connector 2 has been turned through the above-mentioned angle A relative to the panel 4, the ramp 22 of the locking surface 20 comes into register with the ramp 13 of the abutment element 12 of the panel 2, as shown in FIGS. 5 and 6.

The ramp 22 pressing against the ramp 13 increases the opposing torque as the connector 4 continues to be turned relative to the panel 2.

The connector 4 becomes locked to the panel 2 when the locking surface 20 disengages from the ramp 13, as shown in FIG. 7.

The locking surface 20 disengaging from the ramp 13 can generate an audible sound informing the operator that the engagement operation has come to an end.

The locking portion 10 is then held between the first abutment element 12 and the second abutment element 14, as shown in FIG. 8.

In the example described, the abutment element 12 and the locking portion 10 are elastically deformable to a small extent so to enable locking to be obtained by snap-fastening.

It should be observed hat, at the end of engagement, the locking surface 20 is spaced apart from the face 6 of the panel 2, as shown in FIG. 8.

In addition, the low portion 25 of the clamping surface 21 presses against the face 6 of the panel 2, thus ensuring an effective ground connection between the connector and the panel 2.

In the example described, once the connector 4 is locked to the panel 2, it is no longer removable.

The locking portions 10 and the zones 8 of the opening 3 may be arranged in such a manner as to perform a keying function when the connector 4 is engaged with the panel 2.

Naturally, the invention is not limited to the embodiment described above.

For example, as shown in FIG. 9, the abutment element 12 each formed by a ramp 13 could be replaced by an elastically deformable tab 35 formed by being cut out from the panel.

The presence of the tabs 35 can enable the connector to be separated from the panel, should that be necessary.

The above-described abutment elements 14, each having a face perpendicular to the face 6 of the panel 2, for example, could be replaced by respective bosses 36, as shown in FIG. 9.

Figure 10:
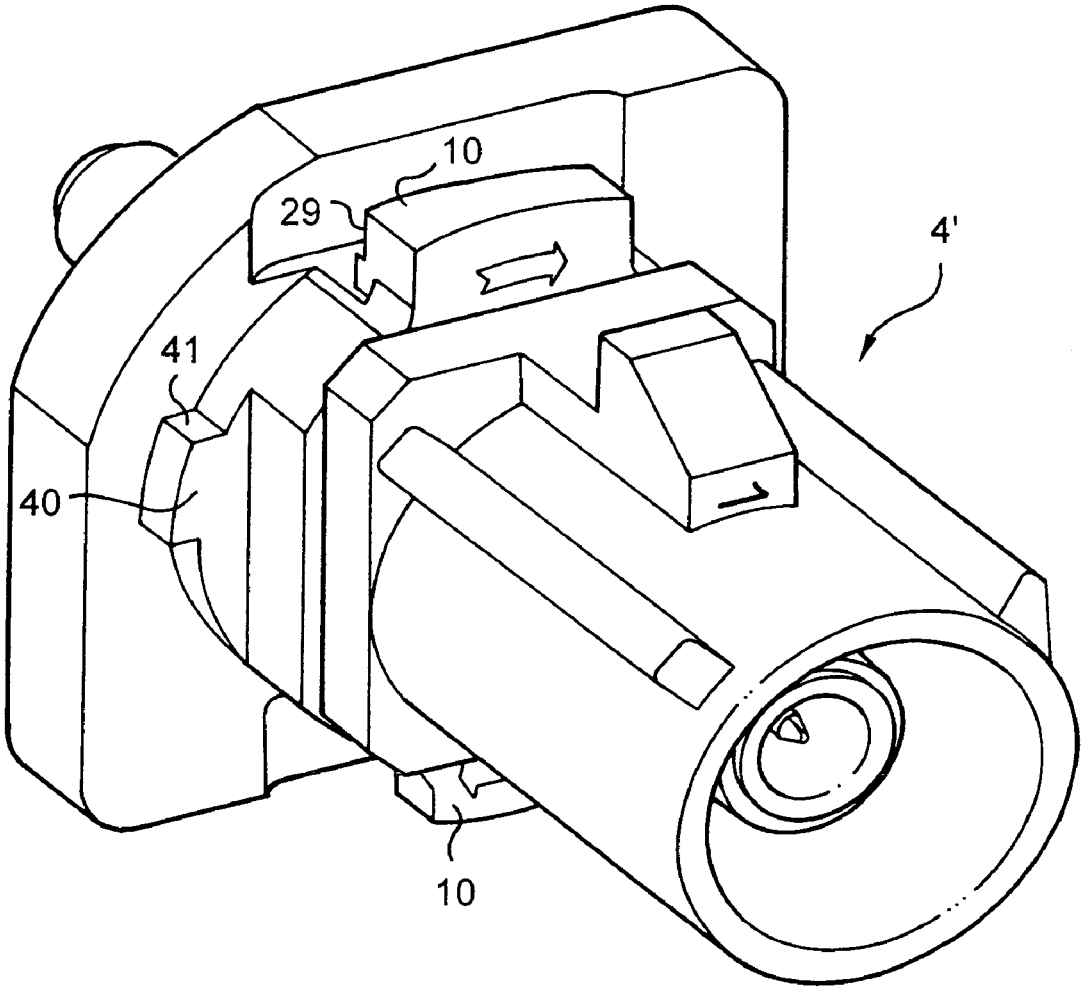
FIG. 10 is a fragmentary and diagrammatic view in perspective of a connector constituting another embodiment of the invention.

FIGS. 10 and 11 show respectively a connector 4' and a panel 2' of an assembly 1' constituting another embodiment of the invention.

The connector 4' is substantially analogous to the above-described connector 4, but with the difference that the connector 4' has a tab 40 arranged to press against an abutment element 42 of the panel 2' when the connector 4' is locked to the panel 2'.

The panel 2' has two first abutment elements 12 analogous to those 12 described with reference to the panel 2.

As shown in FIG. 1, the panel 2' has a single second abutment element 42 made in the thickness of the panel 2' in its opening 3. The abutment element 42 is made, for example, on a right-angled corner of the opening 3.

The tab 40 has a face 41 pressing against the second abutment element 42.

Each locking portion 10 of the connector 4' has a face 29 pressing against the corresponding first abutment element 12 when the connector 4' is locked to the panel 2'.

In the example described, the bearing faces 29 and 41 are disposed in perpendicular manner.

The various steps in engaging the connector 4' to the panel 2' in order to form the assembly 1' are described below with reference to FIGS. 12 to 14.

Figure 12:
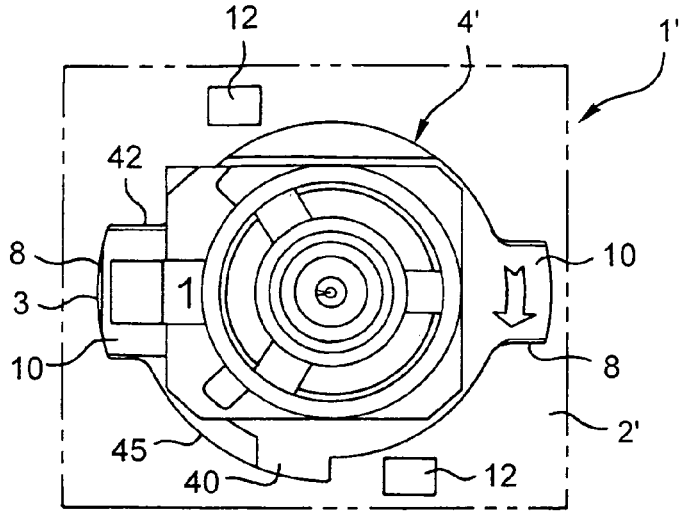
FIGS. 12 to 14 are diagrams showing different steps in engaging the FIG. 10 connector with the FIG. 11 panel.

In the step of FIG. 12, the connector 4' is inserted into the opening 3 of the panel 2', the locking portions 10 being engaged in the zones 8 of the opening 3.

Figure 13:
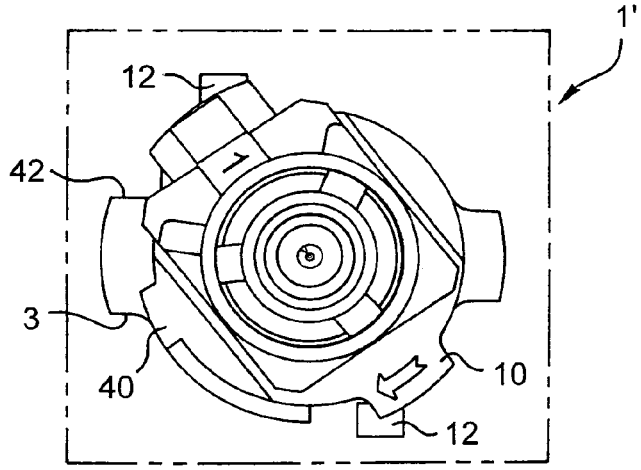

The tab 40 extends in a zone 45 of the opening 3, this zone 45 being of a shape selected to enable the tab 40 to remain in the opening 3 while the connector 4' is turned relative to the panel 2' for locking purposes, as shown in FIGS. 12 and 13.

This zone 45 of the opening 3, e.g. in the form of a circular arc, extends in particular over an angular sector that is less than or equal to 90°.

Figure 14:
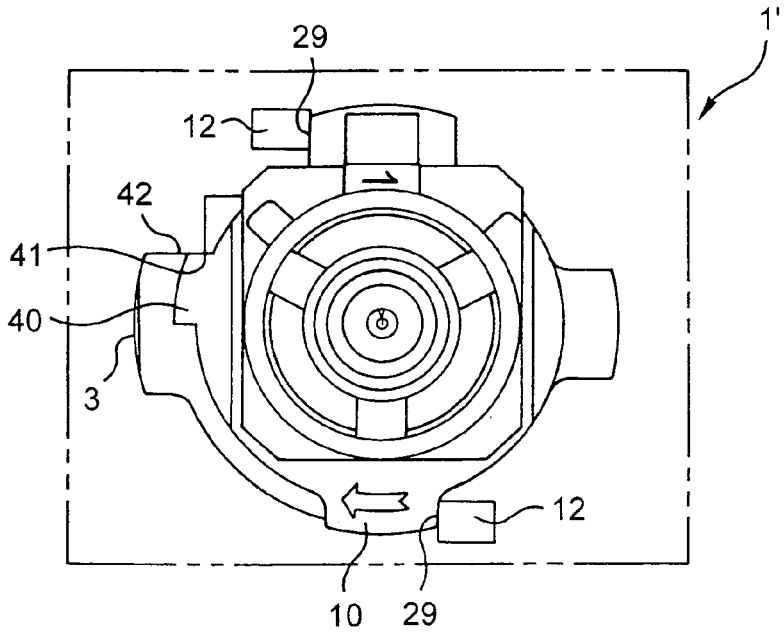

At the end of locking, the bearing face 41 of the tab 40 comes to press against the abutment element 42, where, in association with the locking portions 10 having their faces 29 pressing against the first abutment elements 12, it serves to prevent the connector 4' from moving relative to the panel 2', as shown in FIG. 14.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An electrical connection assembly comprising:

a panel including at least one opening; and an electrical connector configured to be engaged through the opening of the panel, the connector including an enlarged portion configured to press against a first face of the panel when the connector is engaged therewith, wherein the panel includes at least first and second abutment elements and at least one electrically conductive zone, the first abutment element at least projecting from a second face of the panel opposite from the first face;

the connector includes at least one locking portion configured to go past the first abutment element of the panel as a result of the connector performing a turning movement relative to the panel to enable the connector to be locked to the panel, the connector being configured to be held stationary relative to the panel by pressing against the first and second abutment elements; and the connector includes at least one electrically conductive portion that comes into contact with the conductive zone of the panel when the connector is locked to the panel.

2. An assembly according to claim 1, wherein the second abutment element projects from the second face of the panel, and wherein the locking portion of the connector is configured to engage between the first and second abutment elements when the connector is locked to the panel.

3. An assembly according to claim 1, wherein the second abutment element is made in a thickness of the panel, in the opening of the panel, and wherein the connector includes at least one tab arranged to press against the second abutment element when the connector is locked to the panel.

4. An assembly according to claim 1, wherein the enlarged portion of the connector is electrically conductive.

5. An assembly according to claim 1, wherein the abutment elements of the panel and the locking portion of the connector are configured such that the locking portion of the connector engages between the abutment elements of the panel in a locking manner.

6. An assembly according to claim 1, wherein the abutment elements of the panel and the locking portion of the connector are configured such that the locking portion of the connector engages between the abutment element of the panel in a removable manner.

7. A method of engaging a connector with a panel in an assembly according to claim 1, the method comprising:

inserting the connector through the opening in the panel so that the enlarged portion of the connector comes to face the first face of the panel and the locking portion comes to face the second face of the panel; and turning the connector relative to the panel so as to cause the locking portion to go past the first abutment element.

8. An assembly according to claim 1, wherein the locking portion of the connector includes a locking surface configured to press against the first abutment element when the connector is turned relative to the panel for locking.

9. An assembly according to claim 8, wherein the locking surface is configured to be spaced apart from the second face of the panel, at least when the connector is locked to the panel.

10. An assembly according to claim 8, wherein the first abutment element includes a first ramp, and wherein the locking surface includes a second ramp configured to press against the first ramp of the abutment element when the connector is turned relative to the panel for locking.

11. An assembly according to claim 10, wherein the first and second ramps are planer.

12. An assembly according to claim 1, wherein the connector includes a clamping surface configured to press against the second face of the panel, at least when the connector is locked to the panel.

13. An assembly according to claim 12, wherein the clamping surface is formed at least in part on the locking portion of the connector.

14. An assembly according to claim 13, wherein the clamping surface extends substantially parallel to a locking surface of the locking portion.

15. An assembly according to claim 1, wherein the connector includes at least two locking portions that are angularly spaced apart, and the opening in the panel including two zones configured to enable the locking portions of the connector to be inserted through the opening, wherein the locking portions of the connector and the zones of the opening in the panel are configured such that the connector is lockable to the panel only when the connector is in one particular orientation relative to the panel.

16. An assembly according to claim 15, wherein the connector includes a longitudinal axis, and wherein the locking portions of the connector are configured asymmetrical relative to a plane containing the longitudinal axis of the connector.

* * * * *